US007111877B2

(12) United States Patent
Larsen et al.

(10) Patent No.: US 7,111,877 B2
(45) Date of Patent: Sep. 26, 2006

(54) LATCH WITH UNI-DIRECTIONAL POWER RELEASE MECHANISM

(75) Inventors: Christopher L. Larsen, Toronto (CA); Jeffrey R. F. Domenchini, Etobicoke (CA); Keith A. Morgan, Toronto (CA)

(73) Assignee: Intier Automotive Closures Inc., Newmarket (CA)

( * ) Notice: Subject to any disclaimer, the term of this patent is extended or adjusted under 35 U.S.C. 154(b) by 129 days.

(21) Appl. No.: 10/489,281

(22) PCT Filed: Sep. 17, 2002

(86) PCT No.: PCT/CA02/01405

§ 371 (c)(1),
(2), (4) Date: Mar. 11, 2004

(87) PCT Pub. No.: WO03/025319

PCT Pub. Date: Mar. 27, 2003

(65) Prior Publication Data

US 2004/0239124 A1 Dec. 2, 2004

(51) Int. Cl.
*E05C 3/06* (2006.01)

(52) U.S. Cl. ..... 292/216; 292/201

(58) Field of Classification Search ..... 292/201, 292/216, DIG. 23

See application file for complete search history.

(56) References Cited

U.S. PATENT DOCUMENTS 5,934,717 A 8/1999 Wirths et al.
6,076,868 A 6/2000 Roger, Jr. et al.
6,155,124 A 12/2000 Wirths
6,390,517 B1 * 5/2002 Ehret ..... 292/201
2003/0038484 A1 * 2/2003 Schwaiger et al. ..... 292/201

FOREIGN PATENT DOCUMENTS

DE 4218177 A1 12/1993
DE 19617428 A1 11/1997
DE 19725416 C1 1/1999

* cited by examiner

*Primary Examiner*—Gary Estremsky
(74) *Attorney, Agent, or Firm*—Clark Hill PLC

(57) ABSTRACT

A latch has a unidirectional power release mechanism. The mechanism has a rotatable gear with a boss on the gear, a motor for rotating the gear to orbit the gear boss through an operating cycle of the mechanism, a ratchet movable from a latched position to an unlatched position, a pawl lever, a pawl, and a toggle which moves between a first toggle position and a second toggle position to set the limits of the operating cycle of the mechanism. The toggle pivots in response to the orbiting gear boss and presents a stop for the gear boss at the end of the operating cycle. The gear boss effects movement of the pawl lever to effect unlatching and stops the orbiting gear boss when it encounters the stop. The toggle is pivoted back removing the stop in response to the ratchet rotating to the latched position.

12 Claims, 6 Drawing Sheets

LATCH WITH UNI-DIRECTIONAL POWER RELEASE MECHANISM

FIELD OF THE INVENTION

The present invention relates to a latch for an automotive deck lid or liftgate in which the latch has a unidirectional power release mechanism.

BACKGROUND OF THE INVENTION

Many of today's automotive vehicles, such as sport utility vehicles and minivans, are provided with liftgates having latches with power releases. It is typical in these power releases to use a return spring to return the mechanism to a rest position after operating which can produce undesirable noise and detract from the power and efficiency of the mechanism. The latch closing spring is generally large and undesirably noisy in its operation.

BMW incorporates into certain of its vehicles a deck lid latch that operates without a return spring. In the BMW design there is a rotating actuator that is controlled to move through only a single revolution by using the latch pawl as an actuator stop. There is disadvantage in this type of latch as the pawl and the stop have a one-piece construction which denies independent motion of the pawl. Furthermore, the pawl is large and heavy as a result of the inclusion of the stop feature on the pawl. Furthermore, the pawl with its built in stop works only on a one position ratchet.

Other examples of latches with rotating actuators include: DE 42 18 177; U.S. Pat. Nos. 5,934,717; 6,076,868; and 6,155,124.

SUMMARY OF THE PRESENT INVENTION

The present invention provides a latch for an automotive deck lid or liftgate which has a unidirectional power release mechanism in which the mechanism is reset by the ratchet and not the pawl. This provides a number of advantages over the prior art construction in that the pawl is small, light in weight and separate from the pawl release lever allowing independent motion of the pawl. Furthermore, the mechanism of the present invention will work with a two locking position ratchet.

More specifically, the latch with its unidirectional power release mechanism of the present invention has a rotatable gear with a gear boss thereon. A motor drivingly engages the gear to orbit the gear boss through an operating cycle of the power release mechanism. A ratchet is pivotally movable between a latched position and an unlatched position. The ratchet is biased to the unlatched position. A pawl is pivotally movable between a ratchet engaged position to hold the ratchet in the latched position and a disengaged position allowing free rotation of the ratchet. The pawl is biased to the ratchet engaged position. A pawl lever is pivotally mounted to engage the gear boss and pivot in response to engagement therewith and thereby responsively pivot the pawl away from the ratchet engaged position, allowing free rotation of the ratchet. A toggle is pivotally movable between a first toggle position and a second toggle position. The toggle is biased to either the first toggle position or the second toggle position. The orbiting gear boss encounter the toggle and pivots the toggle from the first toggle position to the second toggle position. The toggle presents a stop to the orbiting gear boss terminating the operating cycle when the toggle is in the second position. A slapper is movable to pivot the toggle from the second toggle position to the first toggle position in response to the ratchet moving from the unlatched position to the latched position. The operating cycle comprises a start of release phase, a priming phase, a release phase, an end of release phase and a closing phase.

In the start of release phase the toggle is in the first toggle position where the gear boss is free to orbit and the motor starts to rotate the gear to the priming phase in which the gear boss pushes the toggle to the second toggle position. The motor then continues to rotate the gear to the release phase in which the gear boss pushes on the pawl lever which in turn pushes the pawl member, against the pressure of the pawl spring, away from the ratchet engaged position whereby the ratchet, under pressure from the ratchet spring moves away from the closed to the released position. The motor continues to rotate the gear to orbit the gear boss to the end of release phase where the gear boss is blocked by the toggle in the second toggle position to stop rotation of the gear and to stall the motor of the mechanism. The mechanism is now ready for the closing phase in which the ratchet is moved, upon impact with the striker and against the pressure of the ratchet spring, back to the closed position with the pawl spring then moving the pawl member back to the ratchet engaged position to hold the ratchet in its closed position. The ratchet when moving back to its closed position pushes the toggle back to the first toggle position to enable a further operating cycle of the mechanism.

BRIEF DESCRIPTION OF THE DRAWINGS

The above as well as other advantages and features of the present invention will be described in greater detail according to the preferred embodiments of the present invention in which.

DETAILED DESCRIPTION OF THE PREFERRED EMBODIMENTS

Figure 6:
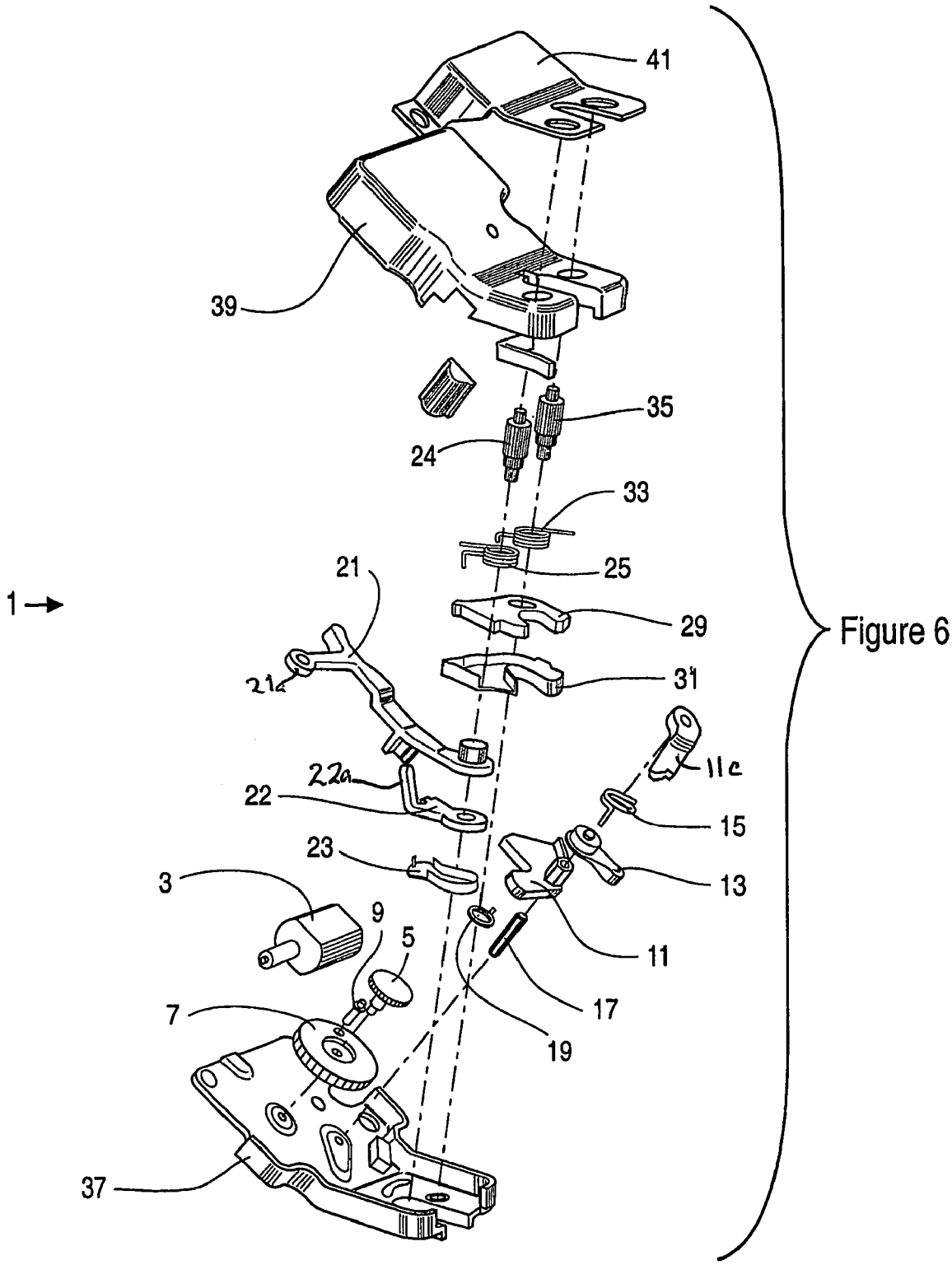
FIG. 6 is an exploded perspective view of the latch.

Referring first to FIG. 6, the latch generally indicated at 1 includes a power release actuator mechanism formed by a motor 3, a main gear 7, a toggle 11, a pawl lever 21, a pawl 22 and a ratchet 29.

Figure 1:
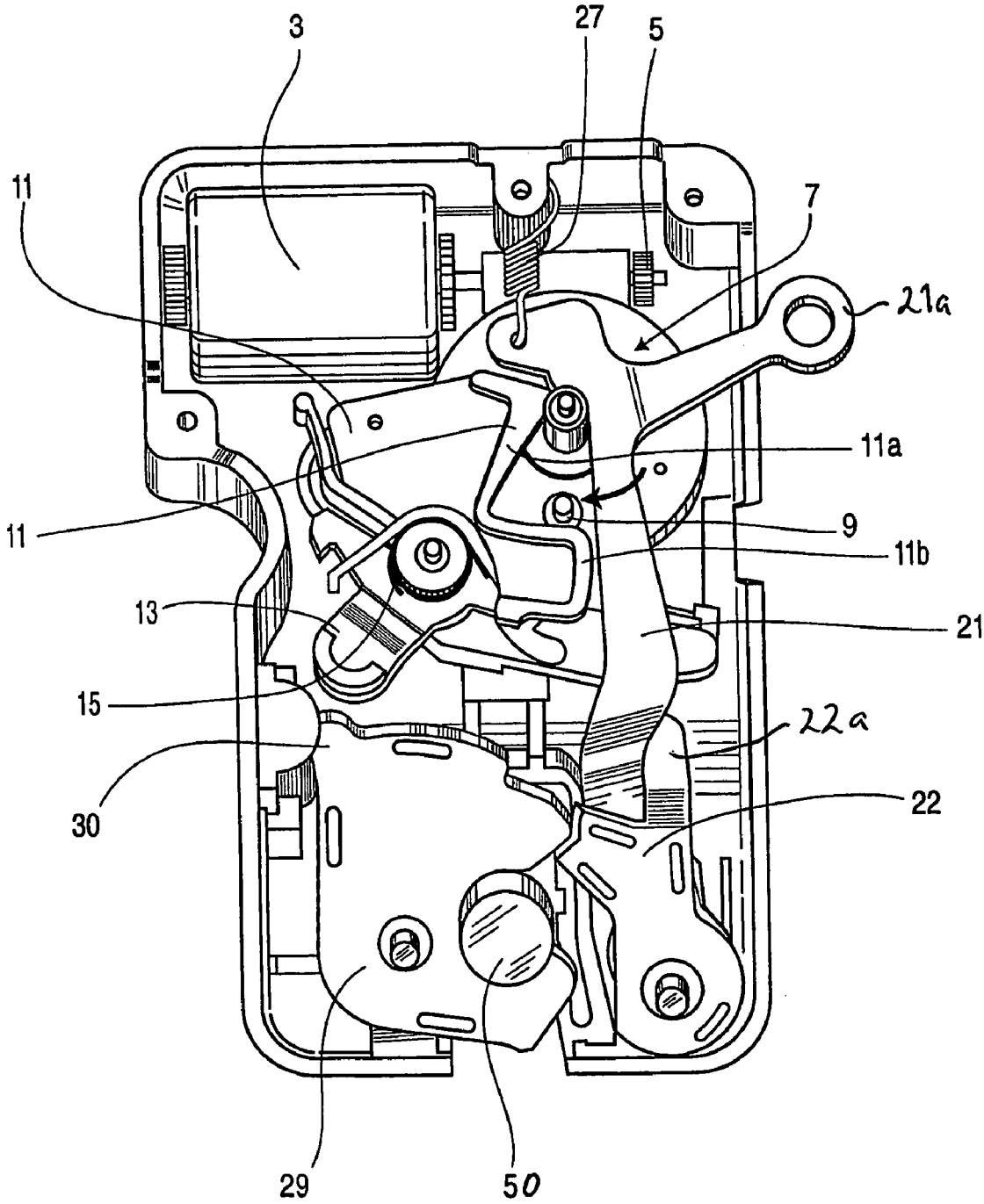
FIGS. 1 through 5 are top views of the latch with the top cover removed showing the different operating phases of the unidirectional power release actuator mechanism according to a preferred embodiment of the present invention.

As better seen in FIG. 1, the output shaft of motor 3 drives a pivot gear 5 which rotates the main gear 7. Gear 7 is provided with a gear boss 9 which orbits through a circular path with rotation of gear 7 during a cycle of operation.

Returning to FIG. 6, toggle 11 which is pivotally mounted on a toggle shaft 17 includes a slapper member 13 which is mounted to swing relative to the main body of the toggle. A slapper spring 15 provides a firm, yet movable connection between the slapper and the main body of the toggle. The toggle 11 is also held in a movable yet firm position within the latch by toggle spring 19.

Although the pawl lever 21 and the pawl 22 are pivotally movable independently of one another they are both mounted on a common pawl pivot 24. The ratchet 29 is mounted on a ratchet pivot 35. Ratchet 29 is conventionally configured in a U-shape. Preferably ratchet 29 has two detents corresponding to primary and secondary latched position.

Pawl spring 27 extends between the base 37 and a distal end of the pawl lever 21 to bias the pawl lever 21 against a central abutment of gear 7 and away from the pawl 22 to allow the pawl to engage the ratchet 29.

Pawl 22 is encased by a cover or encapsulation 23 while the ratchet 29 is covered by encapsulation 31.

The entire mechanism is contained within a housing comprising a base plate 37 and a cover 39 that is preferably made of plastic. A steel reinforcement plate 41 then fits over the plastic cover.

As earlier mentioned in the description FIGS. 1 through 5 show the various different phases of the cycle of operation of the release actuator mechanism.

More specifically, FIG. 1 shows the start of the release cycle. In FIG. 1 the boss 9 of gear 7 is in its "home" position. The motor 3 operates to turn gear 7 orbiting boss 9 in the clockwise direction. Toggle 11 is in a first position which allows the gear boss to orbit enabling initial rotation of gear 7.

Figure 2:
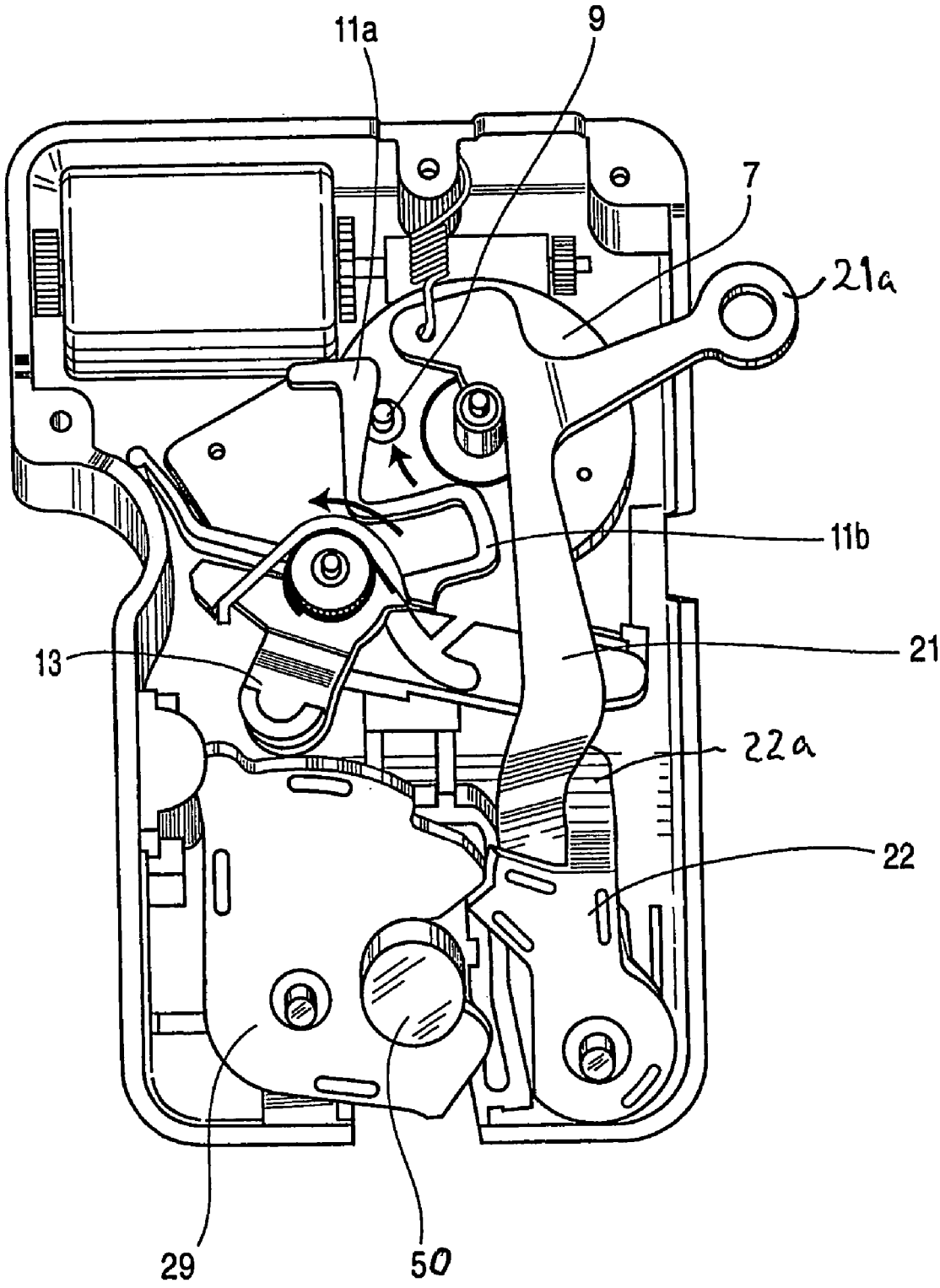

FIG. 2 shows the priming phase of the mechanism. Here, boss 9 has orbited along toggle portion 11*a* pushing the toggle to a second position different from the first position shown in FIG. 1. More specifically, in FIG. 2 the toggle has been pushed by the gear boss 9 such that the toggle has pivoted about the toggle shaft to position toggle portion 11*a* more to the left of the mechanism causing toggle portion 11*b* to pivot up and to the right relative to the FIG. 1 position. As to be described later in detail, this repositioning of the toggle 11 by the gear boss 9 sets the mechanism up for a single rotation of the gear in its operating cycle.

Figure 3:
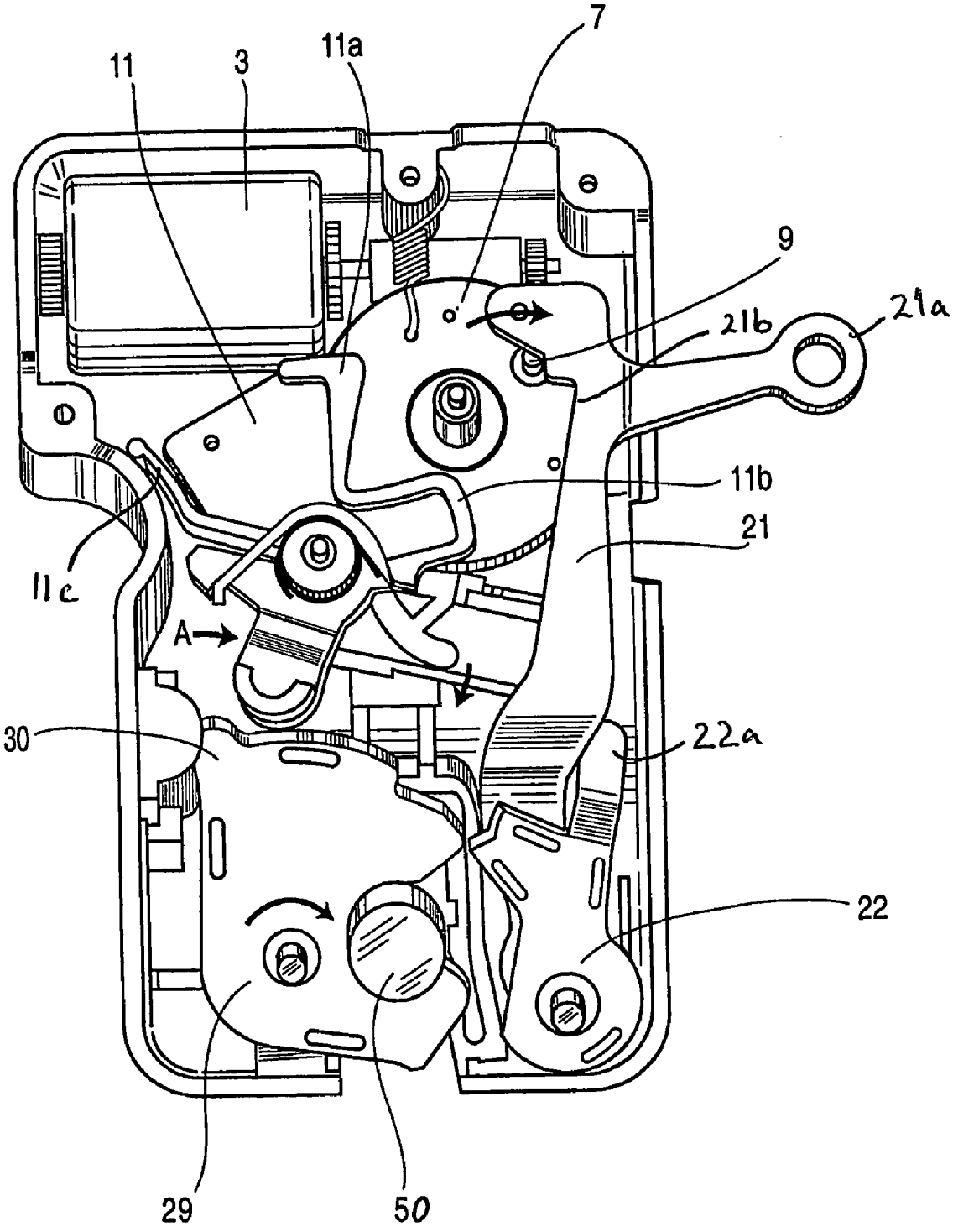

FIG. 3 shows the release phase of the cycle. In this phase, the gear 7 has continued to rotate through the operation of the motor to engage the boss 9 with the pawl lever 21 and responsively push on the pawl lever 21. Note in comparing FIGS. 2 and 3 that in FIG. 3 the pawl lever 21 has been pushed much farther to the right than in the FIG. 2 position.

The pawl lever 21 in turn engages the pawl 22 to also push the pawl 22 away from the ratchet engaging position of FIG. 2 to the disengage position of FIG. 3. In the ratchet engaging position, the pawl 22 engages the ratchet 29 and holds the ratchet 29 in a closed position over a striker 50 engaged by the latch.

Figure 4:
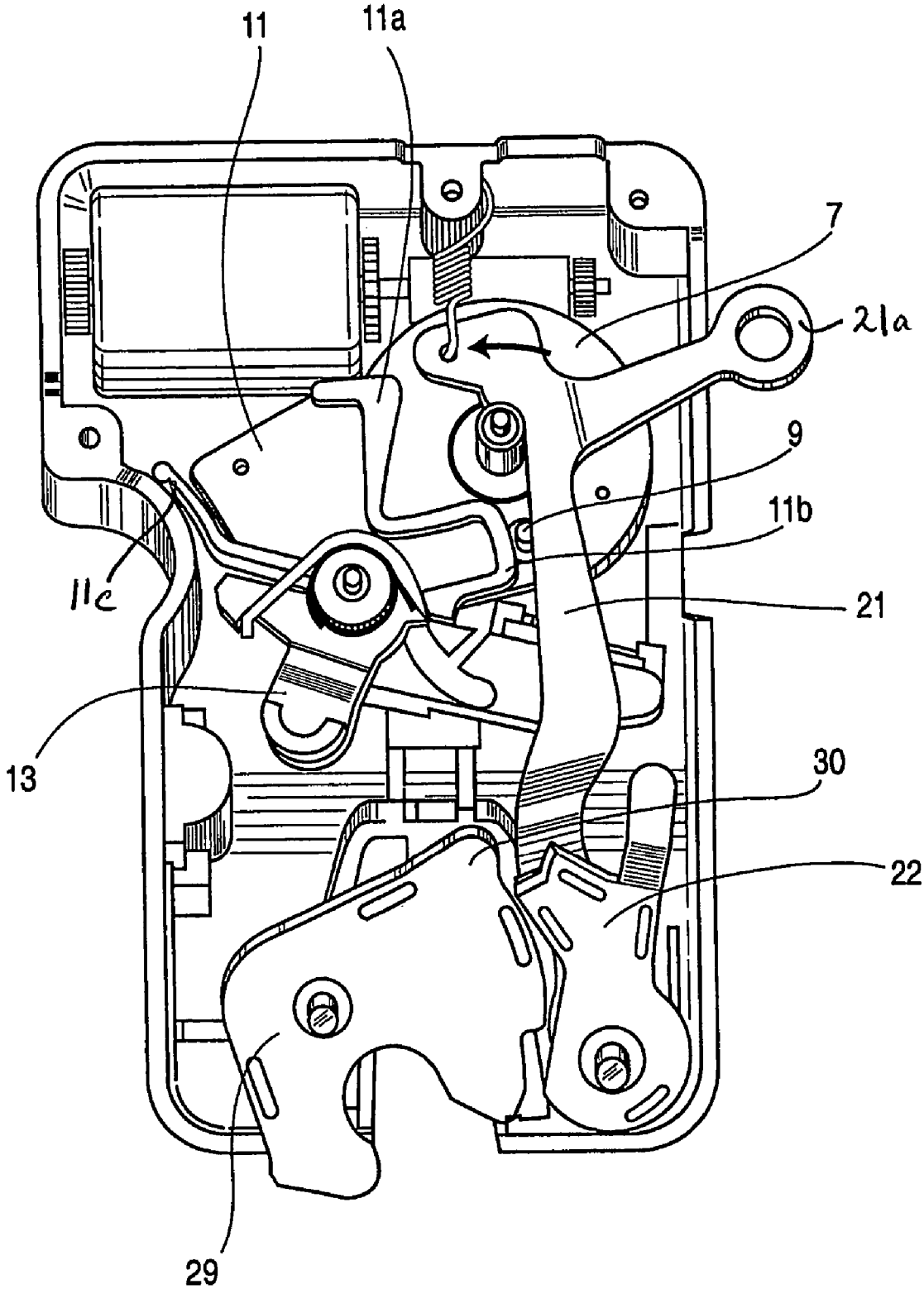

The ratchet spring 33 applies pressure which urges the ratchet to the open or release position i.e., a position in which it would release the striker member. However, the pawl spring 25 urges the pawl 22 to the ratchet engaged position as shown in FIG. 2 that holds the ratchet 29 from springing to its open position. By pushing the pawl lever 21 with the gear boss 9, pawl lever 21 engages pawl arm 22*a* of the pawl 22 moving the pawl 22 away from the ratchet engaged position and as shown in FIG. 3 allowing the ratchet 29 to freely rotate to an open or unlatched position as shown in FIG. 4, i.e., to the end of the opening phase of the cycle. During this phase, the gear boss 9 has been continuing to orbit past the pawl lever 21 until the gear boss 9 runs into and engages toggle portion 11*b*. At this point, the toggle blocks any further rotation of the gear 7 and stalls the operation of the motor 3. This causes a current spike in the motor 3 which responsively shuts down until another operating cycle of the mechanism.

A number of additional steps occur during the end of opening phase of the cycle. First of all, the ratchet protrusion 30 on ratchet 29 has moved from the left side to the right side of the slapper 13. As will be appreciated by comparing FIGS. 3 and 4 of the drawings, slapper 13 must be pushed out of the way by the ratchet to clear the slapper past the ratchet, i.e., the slapper is pivoted in the direction of arrow A shown in FIG. 3 of the drawings as the ratchet 29 rotates releasing the striker 50. Toggle 11 has a biasing arm 11*c* that engages a stop, in this case housing 37, when the toggle is in the second position. The biasing arm 11*c* allows the toggle to over rotate beyond the second position, allowing the ratchet 29 to rotate from the latched position to the unlatched position.

It is apparent to those skilled in the art that the slapper 13 has a one way lost motion type of connection to the toggle. Rotation of the ratchet 29 in the unlatching sense does not affect movement of the toggle 11, whereas rotation in the opposite latching sense pivots the toggle 11 from the second position to the first position. It is understood that other one way lost motion connections that are common in the art, including a ratchet mechanism, may also be incorporated into the present latch.

The toggle 11 remains in the second position of FIG. 4 once the ratchet 29 has rotated to its unlatched position. In addition, the pawl lever 21 has sprung back to its FIG. 1 position while the pawl 22 itself remains in the FIG. 3 position blocked by the ratchet 29 in its open position.

Figure 5:
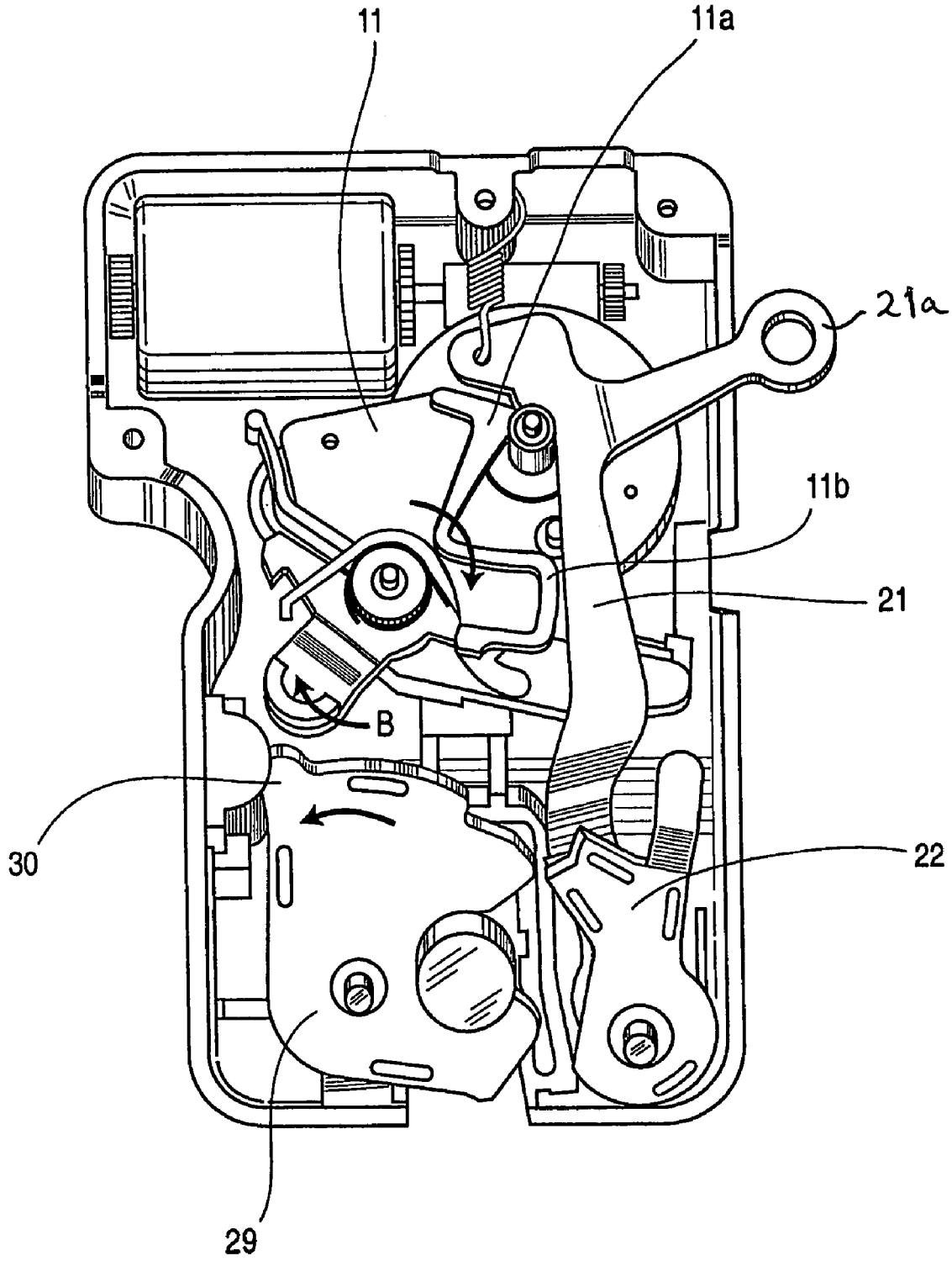

FIG. 5 of the drawings shows the closing phase which is the final phase of the operating cycle of the mechanism. This closing phase is initiated by impacting the ratchet 29 with the striker 50 which causes the ratchet 29 to rotate back to its closed or latched position. As shown in FIG. 5, this frees the pawl 22 to spring back to its ratchet engaged position and prevent the ratchet from opening until the next operating cycle of the mechanism.

As the ratchet 29 is closed by the impact with the striker 50, the ratchet protrusion 30 engages the other side of the slapper 13 to rotate the slapper 13 in the direction of arrow B as shown in FIG. 5 of the drawings. This in turn causes the toggle to move back to the first position of FIG. 1 moving toggle portion 11*b* out the orbital path of the gear boss 9 such that the mechanism is now ready for its next operating cycle.

A number of unique features result from the above operation of the mechanism. For example, the ratchet 29 itself provides a resetting of the mechanism. The toggle lever 11 acts as gear boss stop. The slapper 13 acts in one direction only to permit movement of the toggle by the ratchet with the ratchet effectively bypassing the toggle in the other direction, while the priming of the toggle 11 is done by the gear boss 9 eliminating the requirement for a noisy return spring.

Pawl lever 21 may also be provided with an arm 21*a* that extends out of the housing. Arm 21*a* provides an attachment point for a cable or rod the enables manual operation of the latch 1 independent of powered operation. Preferably, pawl lever 21 has a cam surface 21*b*, as best seen in FIG. 3, that has a stepped configuration. The step extends over center of the gear 7 to present an abutment surface for initial engagement with the gear boss 9. As the gear boss 9 orbits, it will step along the pawl lever 21 and allow the pawl lever 21 to counter rotate and allow the pawl 22 to return to at least a partial ratchet engaging position. The pawl 22 would be able to engage the ratchet at the secondary detent to allow the latch 1 to partially engage. Configuring the cam surface 21*b* in this fashion minimizes the time that the latch 1 would be unlatchable in the event of a power failure.

Although various preferred embodiments of the present invention have been described in detail, it will be appreciated by those skilled in the art that variations may be made without departing from the scope of the appended claims.

What is claimed is:

1. A latch having a unidirectional power release mechanism comprising:

a rotatable gear with a gear boss thereon, a motor drivingly engaging said gear to orbit the gear boss through an operating cycle of the power release mechanism, a ratchet pivotally movable between a latched position and an unlatched position, said ratchet being biased to the unlatched position, a pawl pivotally movable between a ratchet engaged position to hold the ratchet in said latched position and a disengaged position allowing free rotation of said ratchet, said pawl being biased to said ratchet engaged position, a pawl lever pivotally mounted to engage said gear boss and pivot in response to engagement therewith and thereby responsively pivot said pawl away from said ratchet engaged position, allowing free rotation of said ratchet, a toggle pivotally movable between a first toggle position and a second toggle position, said toggle being biased to either the first toggle position or the second toggle position, said orbiting gear boss encountering said toggle and pivoting the toggle from the first toggle position to the second toggle position, said toggle presenting a stop to said orbiting gear boss terminating said operating cycle when said toggle is in said second position, and a slapper movable to pivot the toggle from the second toggle position to the first toggle position in response to the ratchet moving from the unlatched position to the latched position.

2. A latch as claimed in claim 1 wherein said bias of said toggle allows over-rotation of said toggle beyond said second position.

3. A latch as claimed in claim 2 wherein said operating cycle of the mechanism comprises a start of release phase, a priming phase, a release phase, an end of release phase and a closing phase; in the start of release phase the toggle being in the first toggle position where the gear boss is free to orbit and the motor starts to rotate the gear to the priming phase in which the gear boss pushes the toggle to the second toggle position, the motor continuing to rotate the gear to the release phase in which gear boss pushes on the pawl lever which in turn pushes the pawl away from the ratchet engaged position whereby the ratchet moves away from the latched to the unlatched position, the motor continuing to rotate the gear to orbit the gear boss to the end of release phase where the gear boss is blocked by the toggle in the second toggle position to stop rotation of the gear and to stall the motor which is then ready for the closing phase in which the ratchet is moved, upon impact with the striker back to the latched position, pushing the toggle back to the first toggle position to enable a further operating cycle of the mechanism.

4. A latch as claimed in claim 2 wherein said pawl lever and said pawl are mounted on a common pivot.

5. A latch as claimed in claim 4 wherein said latch further comprises housing comprising a base plate and a cover.

6. A latch as claimed in claim 5 wherein said pawl lever has an arm configured to extend out of the housing enabling manual operation of said latch.

7. A latch as claimed in claim 1 wherein said toggle has a one way lost motion connection to said slapper, said lost motion allowing said ratchet to rotate from the latched position to the unlatched position.

8. A latch (1) having a unidirectional power release mechanism, said latch comprising:

a rotatable gear (7) with a boss (9), a motor (3) operative engaging the gear effecting an orbital path of the gear boss through an operating cycle of the mechanism, a ratchet (29) movable from a latched position to an unlatched position and biased to the unlatched position, a pawl (22) operatively engaging the ratchet and biased to retain the ratchet in the latched position, a pawl lever (21) pivotally movable to engage the pawl and the orbiting gear boss, and a toggle (11) pivotally movable between a first toggle position and a second toggle position to set the limits of the operating cycle of the mechanism, the toggle (11) being biased to either the first toggle position or the second toggle position, the orbiting gear boss encountering the toggle and pivoting the toggle from the first toggle position to the second tongle position, wherein said second position presents a stop for the gear boss (9) at the end of the operating cycle, the gear boss (9) effecting movement of the pawl lever (21) to effect unlatching of said ratchet and stopping upon encountering the stop, the toggle (11) being pivoted back to the first toggle position removing the stop in response to the ratchet (29) rotating to the latched position.

9. A latch as claimed in claim 8 wherein said toggle has a slapper having a one way lost motion connection with said toggle, said slapper positioned to engage said ratchet as said ratchet rotates between said latched and unlatched positions, said lost motion connection enabling said pivoting movement of said toggle from the second toggle position to the first toggle position upon rotation of the ratchet from the unlatched position to the latched position and disabling movement of the toggle upon rotation of the ratchet from the latched position to the unlatched position.

10. A latch as claimed in claim 9 wherein said pawl lever and said pawl are mounted on a common pivot.

11. A latch as claimed in claim 10 wherein said latch further comprises housing comprising a base plate and a cover.

12. A latch as claimed in claim 11 wherein said pawl lever has an arm configured to extend out of the housing enabling manual operation of said latch.

* * * * *